US008447194B2

(12) United States Patent
Ozeki

(10) Patent No.: US 8,447,194 B2
(45) Date of Patent: May 21, 2013

(54) IMAGE FORMING APPARATUS FOR CONTROLLING DISPOSAL OF DEVELOPER

(75) Inventor: Fumitaka Ozeki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 48 days.

(21) Appl. No.: 12/801,748

(22) Filed: Jun. 23, 2010

(65) Prior Publication Data

US 2010/0329703 A1 Dec. 30, 2010

(30) Foreign Application Priority Data

Jun. 24, 2009 (JP) ..... 2009-149551

(51) Int. Cl.
*G03G 15/08* (2006.01)
*G03G 15/00* (2006.01)

(52) U.S. Cl.
USPC ..... 399/27; 399/236

(58) Field of Classification Search ..... 399/27, 399/53, 222, 236, 265, 281, 257
See application file for complete search history.

(56) References Cited

U.S. PATENT DOCUMENTS

2004/0184843 A1 9/2004 Sato
2006/0127133 A1* 6/2006 Suzuki ..... 399/167
2006/0198644 A1* 9/2006 Itagaki et al. ..... 399/27
2008/0152366 A1 6/2008 Endou et al.
2008/0240764 A1 10/2008 Yamane
2009/0274490 A1* 11/2009 Anderson et al. ..... 399/281

FOREIGN PATENT DOCUMENTS

JP 01068776 A * 3/1989
JP 09-258548 A 10/1997
JP 2004-117748 A 4/2004
JP 2006-084824 A 3/2006
JP 2008-158196 A 7/2008
JP 2008-242394 A 10/2008
JP 2009020465 A * 1/2009
JP 2009-103970 A 5/2009

* cited by examiner

*Primary Examiner* — Walter L Lindsay, Jr.
*Assistant Examiner* — Billy J Lactaoen
(74) *Attorney, Agent, or Firm* — Rabin & Berdo, P.C.

(57) ABSTRACT

An image forming apparatus includes a developer bearing body for supplying developer to a surface of the image bearing body, on which an electrostatic latent image is formed by a latent image forming unit; a driving unit for rotating the developer bearing body; a speed control unit for determining a rotation speed of the developer bearing body; a drive control unit for controlling the driving unit so that the developer bearing body rotates at the determined rotation speed; and a control unit for determining the amount of developer to be disposed of on the basis of the determined rotation speed and controlling disposal of the determined amount of developer on the surface of the developer bearing body.

13 Claims, 11 Drawing Sheets

FIG.3

| LINEAR SPEED RATIO | AMOUNT OF TONER TO BE DISPOSED OF |
|---|---|
| 1.0 | 1 % |
| 1.2 | 3 % |
| 1.4 | 5 % |

FIG.9

| AMOUNT OF TONER TO BE DISPOSED OF | | AVERAGE PRINT IMAGE DENSITY D (%) | | | |
|---|---|---|---|---|---|
| | | $0 \leqq D < 1$ | $1 \leqq D < 3$ | $3 \leqq D < 5$ | $5 \leqq D$ |
| LINEAR SPEED RATIO | 1.0 | 1 % | 0 | 0 | 0 |
| | 1.2 | 3 % | 2 % | 0 | 0 |
| | 1.4 | 5 % | 4 % | 2 % | 0 |

IMAGE FORMING APPARATUS FOR CONTROLLING DISPOSAL OF DEVELOPER

BACKGROUND OF THE INVENTION

1. Field of the Invention

The present invention relates to an image forming apparatus.

2. Description of the Related Art

In conventional image forming apparatuses such as electrophotographic printers and photocopiers, a developing roller develops an electrostatic latent image to form a toner image on a surface of the photosensitive drum, the toner image is transferred onto a record medium such as a paper, and thereafter the toner image is fixed to the record medium. Such apparatus is disclosed in Japanese Patent Kokai Publication No. 2006-84824, for example.

However, the above-described conventional image forming apparatus has a problem that the fast linear speed of the surface of the developing roller accelerates deterioration of toner on the surface of the developing roller, thereby degrading the quality of an image formed on a record medium.

SUMMARY OF THE INVENTION

It is therefore an object of the present invention to provide an image forming apparatus that can form an image with high quality.

According to an aspect of the present invention, an image forming apparatus includes: an image bearing body; a first driving unit for rotating the image bearing body; a latent image forming unit for forming an electrostatic latent image on a surface of the image bearing body; a developer bearing body for supplying developer to the surface of the image bearing body; a second driving unit for rotating the developer bearing body; a speed control unit for determining a rotation speed of the developer bearing body; a drive control unit for controlling the second driving unit so that the developer bearing body rotates at the determined rotation speed; and a control unit for controlling disposal of the developer on a surface of the developer bearing body so that the amount of developer to be disposed of is determined on the basis of the determined rotation speed and the determined amount of developer is moved from the surface of the developer bearing body to the surface of the image bearing body.

According to another aspect of the present invention, an image forming apparatus includes a developer bearing body for supplying developer to a surface of the image bearing body, on which an electrostatic latent image is formed by a latent image forming unit; a driving unit for rotating the developer bearing body; a speed control unit for determining a rotation speed of the developer bearing body; a drive control unit for controlling the driving unit so that the developer bearing body rotates at the determined rotation speed; and a control unit for determining the amount of developer to be disposed of on the basis of the determined rotation speed and controlling disposal of the determined amount of developer on the surface of the developer bearing body.

BRIEF DESCRIPTION OF THE DRAWINGS

In the attached drawings:

FIG. 3 is a diagram showing an example of the contents of a disposal toner amount table of FIG. 2;

FIG. 9 is a diagram showing an example of the contents of a disposal toner amount table of FIG. 8;

DETAILED DESCRIPTION OF THE INVENTION

Embodiments of the present invention will become apparent from the detailed description given hereinafter. However, it should be understood that the detailed description and specific examples, while indicating preferred embodiments of the invention, are given by way of illustration only and are not limit a scope of the present invention.

First Embodiment

Figure 1:
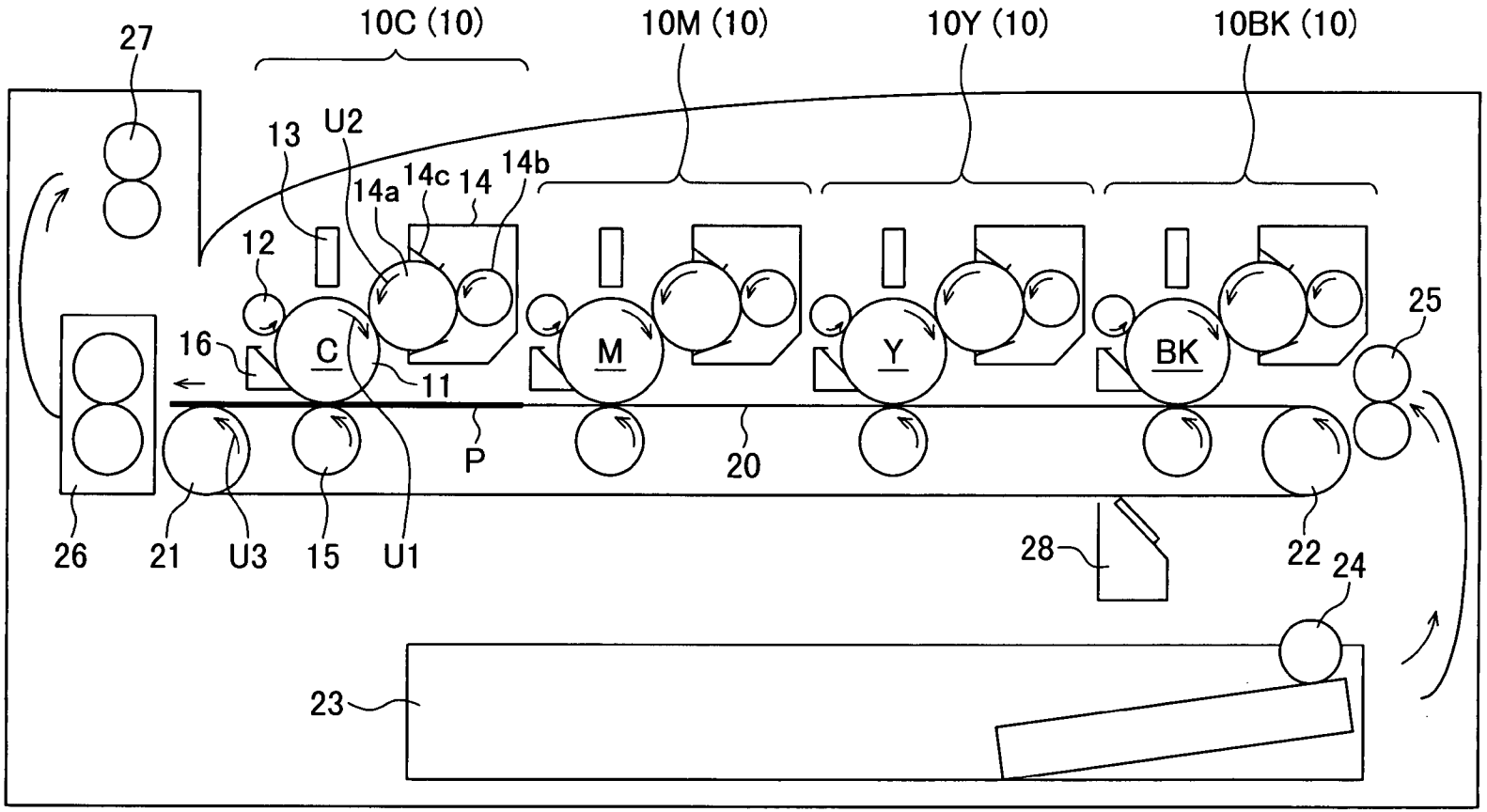
FIG. 1 is a schematic structural diagram illustrating an image forming apparatus according to a first embodiment of the present invention.

FIG. 1 is a schematic structural diagram illustrating an image forming apparatus according to a first embodiment of the present invention. The image forming apparatus is an electrophotographic color printer, for example. However, the image forming apparatus may be a different type of apparatus such as a monochrome printer, a facsimile, a photocopier, or a multifunction peripheral (MFP).

Referring to FIG. 1, the image forming apparatus has a plurality of image forming units 10, the number of which corresponds to the number of colors of developers (e.g., toners). The plurality of image forming units 10 includes a black (BK) image forming unit 10BK for forming a black image on a record medium P such as a paper, a yellow (Y) image forming unit 10Y for forming a yellow image on the record medium P, a magenta (M) image forming unit 10M for forming a magenta image on the record medium P, and a cyan (C) image forming unit 10C for forming a cyan image on the record medium P, for example.

The image forming apparatus also has an endless transfer belt 20, a belt drive roller 21, an idle roller 22, a tray 23, a hopping roller 24, registration rollers 25, a fixing unit 26, ejecting rollers 27, and a belt cleaning device 28.

The transfer belt 20 is provided below the image forming units 10. The transfer belt 20 is stringed between the belt drive roller 21 and the idle roller 22 and conveys the record medium P.

The belt drive roller 21 drives the transfer belt 20, and the idle roller 22 stabilizes the transfer belt 20 which is being moved by the belt drive roller 21.

The tray 23 is provided below the transfer belt 20, for example. The tray 23 can be easily pulled out from and inserted to the apparatus, and contains a plurality of record media P.

The hopping roller 24 is provided on a side of ejection of the tray 23. The hopping roller 24 picks up a record medium P from the tray 23.

The registration rollers 25 are provided on a side of downstream of the hopping roller 24 in a record-medium traveling direction. The registration rollers 25 convey the record medium P picked up by the hopping roller 24 toward the transfer belt 20 without skewing the record medium P.

The fixing unit 26 is provided on a side of downstream of the transfer belt 20 in the record-medium traveling direction. The fixing unit 26 fixes the transferred toner image on the record medium P by applying heat and pressure to the toner image.

The ejecting rollers 27 are provided on a side of downstream of the fixing unit 26 in the record-medium traveling direction. The ejecting rollers 27 eject the record medium P outside the apparatus.

The belt cleaning device 28 is provided below the transfer belt 20. The belt cleaning device 28 is in contact with an outer surface of the transfer belt 20 and removes the toner from the outer surface of the transfer belt 20.

Referring to FIG. 1, each of the image forming units (i.e., each of the black, yellow, magenta, and cyan image forming units 10BK, 10Y, 10M, and 10C) has an image bearing body such as a photosensitive drum 11 for bearing an electrostatic latent image, a charging roller (a charging unit) 12 provided near a surface of the photosensitive drum 11, an exposing unit (a latent image forming unit) such as a light emitting diode (LED) head 13 for irradiating a surface of the photosensitive drum 11 with light to form an electrostatic latent image, a developing device 14 for supplying toner (developer) to the surface of the photosensitive drum 11, a transfer roller 15, and a drum cleaning device 16.

The photosensitive drum 11 includes, for example, a drum-shaped conductive member such as an aluminum drum and a photoconductive layer provided on a surface of the drum-shaped conductive member.

The charging roller 12 is placed so as to be in contact with the surface of the photosensitive drum 11 and uniformly electrifies the surface of the photosensitive drum 11. The charging roller 12 includes, for example, an inner tubular member made of conductive material such as stainless steel and an outer coating coated on an outer surface of the inner tubular member. The outer coating is made of conductive elastic material such as Epichlorohydrin, for example.

The LED head 13 is an exposing device which selectively irradiates a uniformly charged surface of the photosensitive drum 11 with light to form a pattern of an electrostatic latent image based on print image data received or generated by the print control unit 53. The LED head 13 includes LED elements, an LED driving element for driving the LED elements, and a light condensing lens array, for example. The LED head 13 is located such that the irradiating light beams emitted from the LED elements pass through the lens array and then are focused on positions on the surface of the photosensitive drum 11.

The developing device 14 supplies toner to the surface of the photosensitive drum 11, on which an electrostatic latent image is formed, thereby developing the electrostatic latent image to form a toner image. The developing device 14 includes a developer bearing body such as a developing roller 14*a* for supplying toner to the surface of the photosensitive drum 11; a supplying roller 14*b* which is in contact with the developing roller 14*a*; a regulating blade 14*c* which is in contact with the developing roller 14*a*; and a structure for containing toner which is supplied from a toner cartridge (not shown in the figure).

The developing roller 14*a* has an inner tubular member made of conductive material such as stainless steel and an outer coating which is coated on an outer surface of the inner tubular member. The outer coating is made of conductive elastic material such as urethane, for example.

The supplying roller 14*b* has an inner tubular member made of conductive material such as stainless steel and an outer coating which is coated on an outer surface of the inner tubular member. The outer coating is made of elastic foam material such as silicone, for example.

The regulating blade 14*c* is located such that its tip is pressed against the surface of the developing roller 14*a*, and is formed of stainless steel plate-like member, for example.

The transfer roller 15 is provided below the photosensitive drum 11. The transfer roller 15 transfers a toner image formed on the surface of the photosensitive drum 11 to a record medium P or a transfer belt 20. The transfer roller 15 is made of conductive elastic foam, for example.

The drum cleaning device 16 is provided so as to be in contact with the surface of the photosensitive drum 11. The drum cleaning device 16 removes the toner which is not transferred and remains on the surface of the photosensitive drum 11 or disposal toner moved from the developing device 14 to the surface of the photosensitive drum 11. The drum cleaning device 16 is made of rubber blade, for example, and is located such that a tip of the rubber blade is pressed against the surface of the photosensitive drum 11.

In the image forming apparatus of FIG. 1, the surface of the photosensitive drum 11, which has been uniformly charged by the charging roller 12, is exposed by the light beams (or light dots) emitted from the LED head 13 to form an electrostatic latent image pattern, the electrostatic latent image is developed by the developing device 14 to form a toner image on the surface of the photosensitive drum 11, the toner image is transferred onto a record medium P, and the transferred toner image is fixed to the record medium P such as a paper. In the developing device 14, toner is supplied from the toner cartridge, which is not shown in the figure. A developing roller voltage applied to the developing roller 14*a*, a supplying roller voltage applied to the supplying roller 14*b*, and a regulating blade voltage applied to the regulating blade 14*c* are adjusted, toner is charged with electricity by friction charging between the surface of the developing roller 14*a* and a surface of the supplying roller 14*b*, and between the surface of the developing roller 14*a* and the regulating blade 14*c*. As a result, a thin toner layer is formed uniformly on the surface of the developing roller 14*a*.

Figure 2:
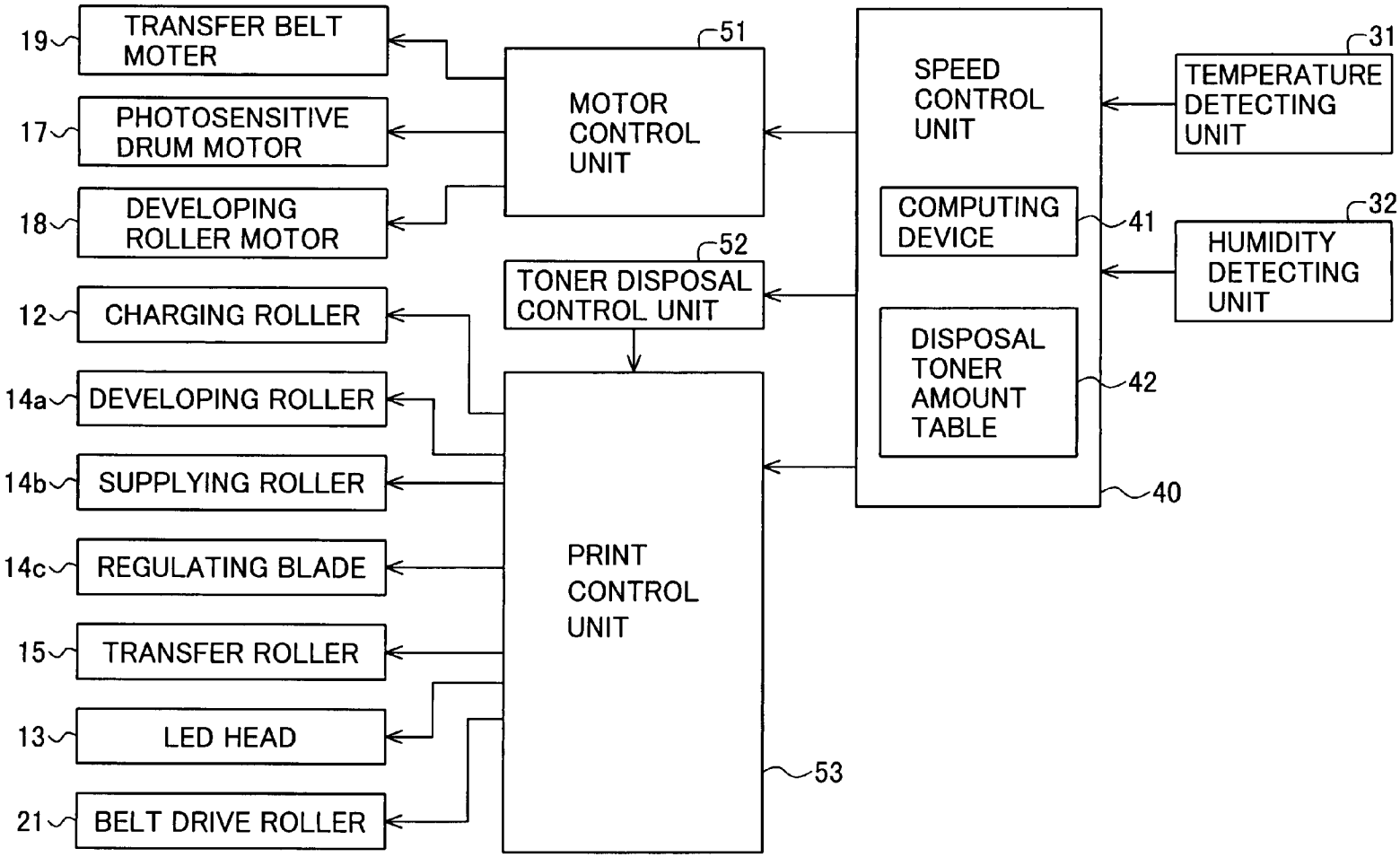
FIG. 2 is a block diagram showing a schematic circuit configuration of the image forming apparatus of FIG. 1.

FIG. 2 is a block diagram showing a schematic circuit configuration of the image forming apparatus of FIG. 1.

Referring to FIG. 2, the image forming apparatus has a photosensitive drum motor 17 as a drum rotation drive unit for rotating the photosensitive drum 11; a developing roller motor 18 as a roller rotation drive unit for rotating the developing roller 14*a*; a transfer belt motor 19 for rotating the belt drive roller 21; and a motor control unit 51 as a drive control unit for driving the photosensitive drum motor 17, the developing roller motor 18, and the transfer belt motor 19.

The photosensitive drum motor 17 rotates the photosensitive drum 11 in a direction of an arrow U1 in FIG. 1. The developing roller motor 18 rotates the developing roller 14*a* in a direction of an arrow U2 in FIG. 1. The transfer belt motor 19 rotates the belt drive roller 21 in a direction of an arrow U3 in FIG. 1. The supplying roller 14*b* is driven to rotate by a driving power transmitted through gears (not shown in the figure) from the developing roller 14*a*. The charging roller 12 is driven to rotate by a driving power transmitted by friction between the charging roller and the surface of the photosensitive drum 11.

The image forming apparatus has a temperature detecting unit 31 for detecting an environmental temperature, and a humidity detecting unit 32 for detecting an environmental humidity. The outputs from the temperature detecting unit 31 and the humidity detecting unit 32 are supplied to a speed control unit 40.

The speed control unit 40 determines a rotation speed (or a linear speed of the surface or a circumferential speed) of the photosensitive drum 11 and a rotation speed (or a linear speed of the surface or a circumferential speed) of the developing roller 14*a* on the basis of the print job supplied from a control unit such as a host control unit (not shown in the figure). Alternatively, the speed control unit 40 may determine a ratio (i.e., a linear speed ratio) of the linear speed of the surface of the developing roller 14*a* to the linear speed of the surface of the photosensitive drum 11 on the bases of the print job supplied from a control unit such as a host control unit (not shown in the figure).

The speed control unit 40 has a function of causing a motor control unit 51 to control the photosensitive drum motor 17 and the developing roller motor 18 so that the photosensitive drum 11 and the developing roller 14*a* are driven to rotate while the determined linear speed ratio is being kept constant. The speed control unit 40 outputs various kinds of control signals and image data, has a computing device 41, a disposal toner amount table 42, and the like, and is configured by a microcomputer or the like. The outputs from the speed control unit 40 are supplied to the motor control unit 51 as a drive control unit, the developer disposal control unit such as a toner disposal control unit 52, and a print control unit 53 as a voltage supply and control unit connected to the toner disposal control unit 52.

The motor control unit 51 has a function of controlling the photosensitive drum motor 17, the developing roller motor 18, and the transfer belt motor 19 on the basis of the control signal from the speed control unit 40. The toner disposal control unit 52 has a function of supplying a command (i.e., a command instructing to perform a toner disposal process) that a predetermined toner image is formed on the surface of the photosensitive drum 11 and the toner image is removed from the surface of the photosensitive drum 11. The "amount of toner to be disposed of" from the developing roller 14*a* is set on the basis of the linear speed ratio or the linear speed of the surface of the developing roller 14*a*.

The print control unit 53 has a function of performing the toner disposal process by controlling voltages applied to the charging roller 12, the developing roller 14*a*, the supplying roller 14*b*, the regulating blade 14*c*, the transfer roller 15, and the belt drive roller 21, and the light emitting of the LED head 13, on the basis of the image data from the speed control unit 40 and a command from the toner disposal control unit 52. The toner disposal process includes, for example, a process in which the toner on the surface of the developing roller 14*a* is moved to the surface of the photosensitive drum 11 and the toner on the surface of the photosensitive drum 11 is collected by the drum cleaning device 16.

FIG. 3 is a diagram showing an example of contents of the disposal toner amount table 42 of FIG. 2. The disposal toner amount table 42 contains linear speed ratios (e.g., 1.0, 1.2, and 1.4) and the "amounts of toner to be disposed of" (e.g., 1%, 3%, and 5%) corresponding to the linear speed ratios respectively.

In the printing process of the image forming apparatus shown in FIG. 1 and FIG. 2, first, the print control unit 53 applies the charging voltage to the charging roller 12, thereby uniformly charging the surface of the photosensitive drum 11 which is rotated by the photosensitive drum motor 17. After the charging, the print control unit 53 controls the LED head 13 on the basis of the image data from the speed control unit 40 so that the LED head 13 emits light beams to form the electrostatic latent image on the surface of the photosensitive drum 11. After that, the print control unit 53 controls the developing roller motor 18 so that the developing roller motor 18 rotates the developing roller 14*a*, on which the toner thin layer are formed, and the electrostatic latent image on the surface of the photosensitive drum 11 is developed. To make the toner thin layer on the developing roller 14*a* uniform and to set an electrical charge amount of the toner thin layer to a predetermined value, the supplying roller voltage and the regulating blade voltage are applied to the supplying roller 14*b* and the regulating blade 14*c* respectively, on the basis of the control signal from the print control unit 53.

Next, on the basis of the control signal from the print control unit 53, the transfer voltage is applied to the transfer roller 15, the belt drive roller 21 is driven to rotate by the transfer belt motor 19, the toner image on the surface of the photosensitive drum 11 is transferred onto the record medium P. After the transfer, the toner image on the record medium P is fixed to the record medium P by the fixing unit 26. The record medium P with the fixed toner image is ejected outside by the ejecting rollers 27, and the printing process is finished.

When the image forming apparatus operates using the negatively electrifiable toner at normal temperature and normal humidity (e.g., at a temperature of 23° C. and a humidity of 50%), the charging voltage is set to −1100 V, the developing roller voltage is set to −200 V, the supplying roller voltage is set to −300 V, and the regulating blade voltage is set to −300 V, by the print control unit 53, for example. The surface of the photosensitive drum 11 is charged by applying a charging voltage more than a predetermined value to the charging roller 12, and the surface voltage of the photosensitive drum 11 increases in accordance with the charging voltage applied to the charging roller 12. In the first embodiment, the surface voltage of the photosensitive drum 11 is −600 V, and the latent image voltage of the electrostatic latent image pattern formed by the light irradiation of the LED head 13 is −50 V. The electrostatic latent image pattern is inversely developed by the toner supplied from the developing roller 14*a*. The negatively electrifiable toner is formed by polystyrene resin particles, for example, and to impart electrification characteristics and flowability to the toner particles, an external additive such as silica is added.

Incidentally, in the image forming apparatus, due to toner deterioration resulting from the external additive removal from the toner particle and the external additive implanting into the toner, the toner which cannot be charged to the normal charging amount are produced. Such deteriorated toner is often adhered to the surface of the photosensitive drum 11 as fogging toner. In such case, the fogging toner is moved to the non-image area on the record medium P and "fog" or "fogging" (which is contamination in a background part (i.e., a non-image area) of a printed image) occurs undesirably.

In the first embodiment, the fogging level is expressed by the color-difference ΔE, which is a value calculated by comparing the reference non-printed color (Lab color space) and the color (Lab color space) in a white area of the record medium P. The lower the color-difference ΔE is, the lower the fogging level becomes. The color (Lab) is measured by a spectrophotometry (Konica Minolta, CM-2600d), for example.

Figure 4:
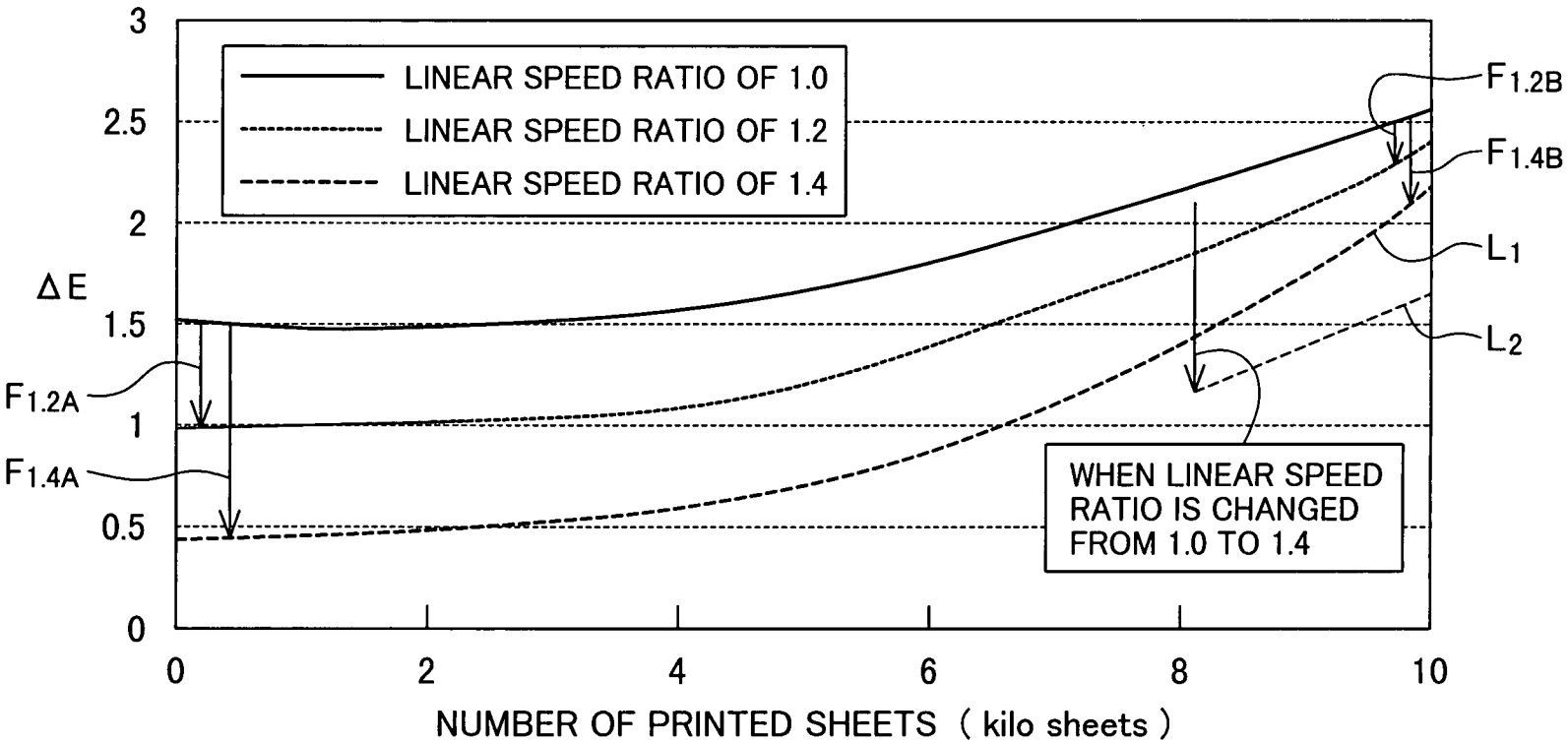
FIG. 4 is a diagram showing experimental results of a relationship between the number of printed sheets and a color-difference as a fogging level in each of different linear speed ratios.

FIG. 4 is a diagram showing experimental results of a relationship between the number of printed sheets and a color-difference ΔE as a fogging level in each of different linear speed ratios of the surface of the developing roller 14*a* to the surface of the photosensitive drum 11.

In FIG. 4, a horizontal axis indicates the number of printed sheets (record media P) in units of "kilo sheets" (=1000 sheets) and a vertical axis indicates a color-difference ΔE as a fogging level. The experimental results were obtained by printing three white sheets (each having a print image density of 0%) in each measuring point at a high temperature and a high humidity environment (e.g., at a temperature of 28° C. and a humidity of 80%). A print image density of 100% means an area ratio of 100% of an area where a solid print is executed over the entire surface of a predetermined possible print area (e.g., corresponding to a single rotation of the photosensitive drum or a single page of the print medium). A print image density of 1% means a printing area of 1% with reference to the printing area of 100%. The linear speed ratio is obtained by dividing the linear speed of the surface of the developing roller 14*a* by the linear speed of the surface of the photosensitive drum 11. The linear speed of the surface of the developing roller 14*a* is changed in accordance with the linear speed of the surface of the photosensitive drum 11. For example, when the photosensitive drum 11 rotates at a linear speed of 140 mm/s and a linear speed ratio is 1.2, the developing roller 14*a* rotates at a linear speed of 168 mm/s (=140 mm/s×1.2). Further, for example, when the photosensitive drum 11 rotates at a linear speed of 140 mm/s and a linear speed ratio is 1.4, the developing roller 14*a* rotates at a linear speed of 196 mm/s (=140 mm/s×1.4).

As can be understood from FIG. 4, as the linear speed ratio relative to a linear speed ratio of 1.0 becomes larger, a fogging level decreases as shown by arrows $F_{1.2A}$ and $F_{1.4A}$, thereby improving the quality of a printed image. However, as can be understood from FIG. 4, when the number of printed sheets increases (e.g., more than approximately 8,000 sheets (=8 kilo sheets)), even if the linear speed ratio relative to a linear speed ratio of 1.0 becomes larger (or the linear speed of the surface of the developing roller 14*a* increases), the decreasing effectiveness (e.g., $F_{1.2B}$ and $F_{1.4B}$) of the fogging level is smaller than the decreasing effectiveness (e.g., $F_{1.2A}$ and $F_{1.4A}$) of the fogging level when the number of printed sheets is approximately 0 sheets. In other words, the more the number of printed sheets increases, the less the decreasing effectiveness of the fogging level becomes.

Further, as shown in FIG. 4, a fogging level (L1) after the 8,000-th sheets when the printing for the 1st to 10,000-th sheets were performed using the linear speed ratio of 1.4 is higher than a fogging level (L2) after the 8,000-th sheets when the printing for the 1st to 8,000-th sheets were performed using the linear speed ratio of 1.0 and the printing after the 8,000-th sheets were performed using the linear speed ratio of 1.4.

The reason why the fogging level increases as the number of printed sheets increases, is that the deteriorated toner is generated on the surface of the developing roller 14*a* by frictional contacts between the surface of the developing roller 14*a* and the other members (the surface of the photosensitive drum 11, a surface of the deteriorated toner increases supplying roller 14*b*, and the regulating blade 14*c*), and therefore the amount of the deteriorated toner increases with increasing a printing period.

Furthermore, the reason why the fogging level increases as the linear speed ratio increases, is that the number of revolutions of the developing roller 14*a* increases as the linear speed ratio increases, and therefore the amount of the deteriorated toner increases with increasing the number of revolutions of the developing roller 14*a*.

In the first embodiment, in order to prevent the quality of a printed image from degrading by keeping a fogging level enough low, the "amount of toner to be disposed of" during one or more toner disposal processes is adjusted in accordance with the linear speed ratio, which is a ratio of a linear speed of the surface of the developing roller 14*a* to a linear speed of the surface of the photosensitive drum 11. However, the "amount of toner to be disposed of" during one or more toner disposal processes may be adjusted in accordance with the linear speed of the surface of the developing roller 14*a*.

In the first embodiment, the toner disposal process is performed by moving the toner (including the deteriorated toner) from the surface of the developing roller 14*a* to the surface of the photosensitive drum 11 and collecting the toner on the surface of the photosensitive drum 11 by the drum cleaning device 16. The toner disposal process will be described more concretely. For example, the charging roller 12 uniformly charges the surface of the photosensitive drum 11, the exposure device irradiates the surface of the photosensitive drum 11 with light to form a predetermined pattern of an electrostatic latent image (having a print image density of 1%, 2%, 3%, 4%, or 5%, for example), the developing roller 14*a* supplies the toner to the surface of the photosensitive drum 11 to form a toner image corresponding to the electrostatic latent image. In the toner disposal process, a record medium P is not carried, the transfer voltage is not applied to the transfer roller 15, and the toner image formed on the surface of the photosensitive drum 11 is collected by the drum cleaning device 16.

However, it is possible to adopt different toner disposal process, in which a record medium P is not carried, the transfer voltage is applied to the transfer roller 15, the toner image formed on the surface of the photosensitive drum 11 is transferred onto the transfer belt 20, and the toner image on the transfer belt 20 is collected by the belt cleaning device 28.

Figure 5:
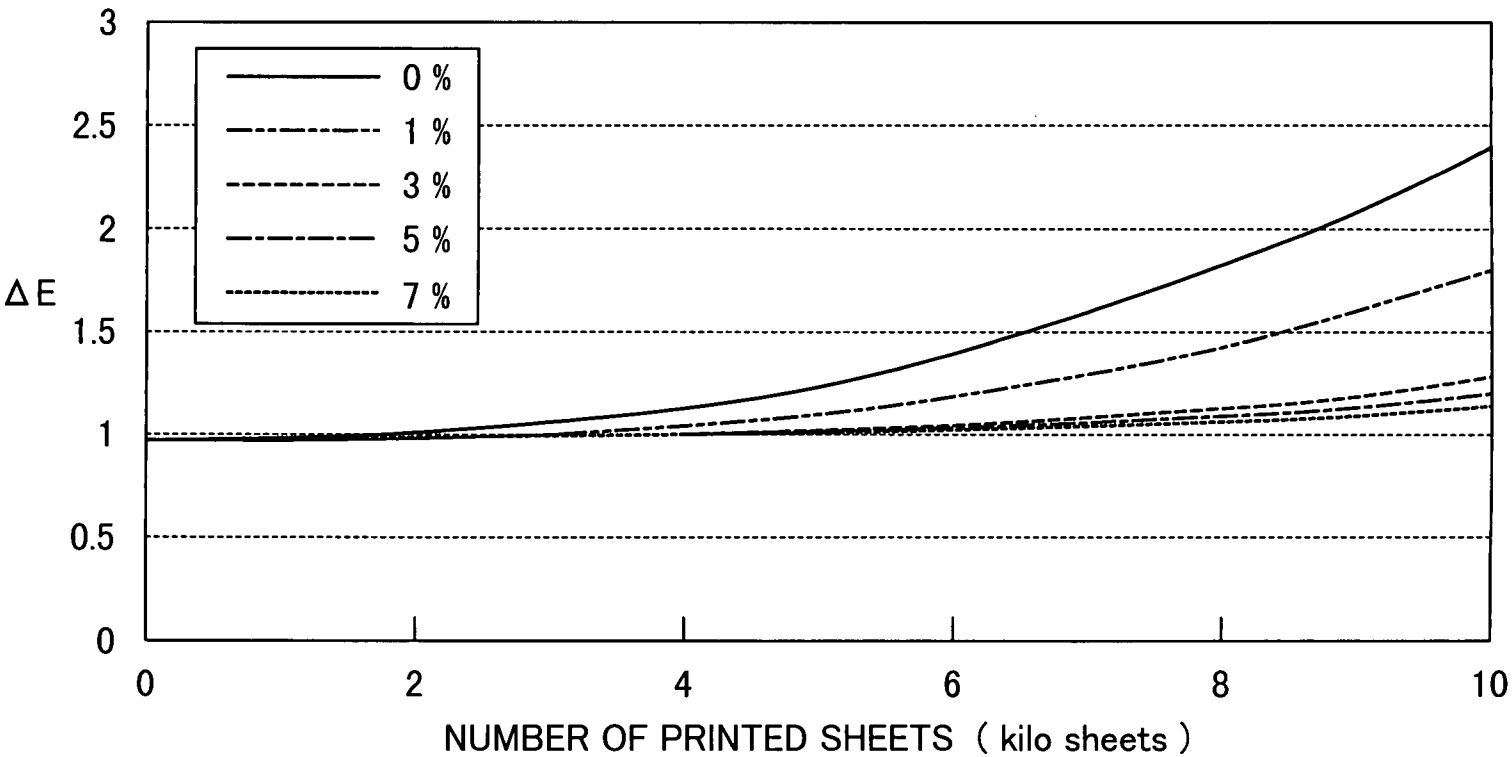
FIG. 5 is a diagram showing experimental results at a linear speed ratio of 1.2, of a relationship between the number of printed sheets and a color-difference as a fogging level in each of toner disposal amounts.

FIG. 5 is a diagram showing experimental results at a linear speed ratio of 1.2, of a relationship between the number of printed sheets and a color-difference as a fogging level in each of different toner disposal amounts. Furthermore, FIG. 6 is a diagram showing experimental results at a linear speed ratio of 1.4, of a relationship between the number of printed sheets and a color-difference as a fogging level in each of different toner disposal amounts.

Figure 6:
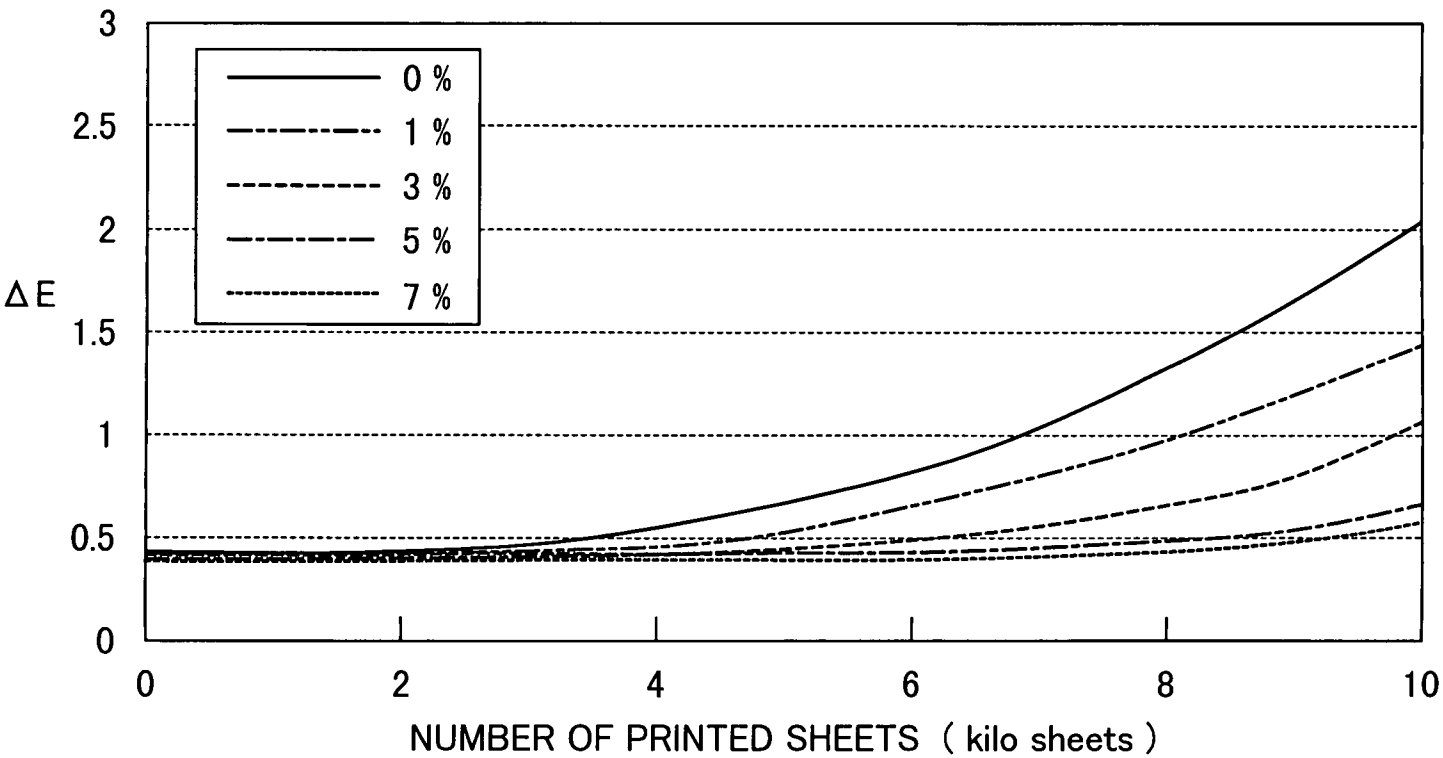
FIG. 6 is a diagram showing experimental results at a linear speed ratio of 1.4, of a relationship between the number of printed sheets and a color-difference as a fogging level in each of toner disposal amounts.

In FIG. 5 and FIG. 6, a horizontal axis indicates the number of printed sheets of the record media P in units of "kilo sheets" (=1000 sheets), and a vertical axis indicates a color-difference ΔE corresponding to a fogging level. The "amounts of toner to be disposed of" (e.g., 0%, 1%, 3%, 5%, or 7%) are expressed as a printing area ratio of an A4-sized paper, where a printing area ratio of 100% indicates the whole-area solid printing. When the whole-area solid printing is performed on an A4-sized paper, the number of exposed dots is (15840×8192) counts, and when a printing area ratio is 5%, the number of exposed dots is (792×8192) counts, for example.

In order to shorten a time period for toner disposal, the printing pattern for the toner disposal is formed to be an area having a width of the whole length along the longitudinal direction of the photosensitive drum 11 and a circumferential length of the photosensitive drum 11 (corresponding to the "amount of toner to be disposed of") light beams by the LED head and developing roller 14*a*. However, the printing pattern (electrostatic latent image pattern) for the toner disposal is not limited to this, and different printing pattern can be adopted as long as the desired amount of toner can be collected from the developing roller 14*a* and disposed of.

Furthermore, in the above, the toner disposal process is performed every time the print job is input to the speed control unit 40 and when the printing preparation is performed. However, the toner disposal process can be performed in other timing such as a middle of consecutive printing process. The other experimental conditions are the same as those in FIG. 3.

As can be understood form the experimental results of FIG. 5 and FIG. 6, by increasing "amount of toner to be disposed of", the increase of the fogging level can be suppressed and the quality of a printed image can be improved.

Furthermore, as can be understood form FIG. 5, when the linear speed ratio is 1.2, the fogging level is enough suppressed by setting the "amount of toner to be disposed of" to 3% or more. Moreover, as can be understood form FIG. 6, when the linear speed ratio is 1.4, the fogging level is enough suppressed by setting the "amount of toner to be disposed of" to 5% or more. Accordingly, it is desirable that the "amount of toner to be disposed of" be increased as the linear speed ratio increases.

Figure 7:
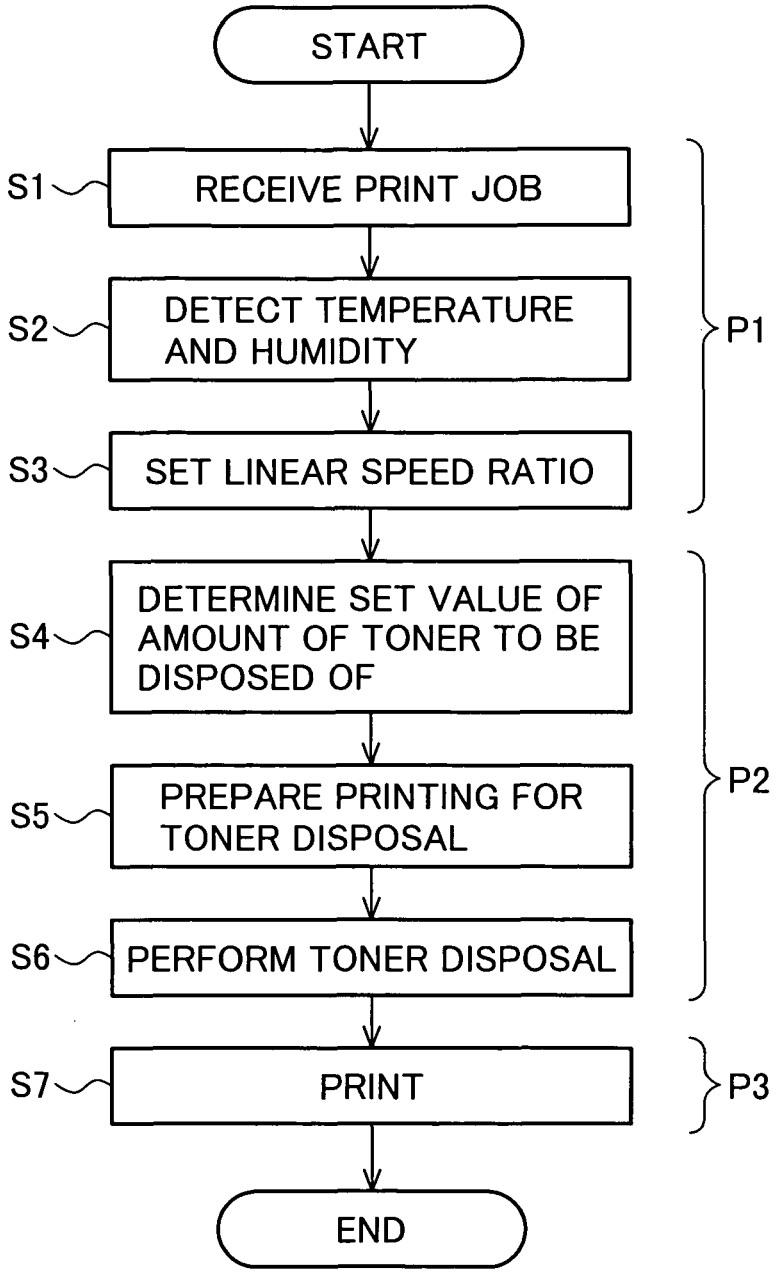
FIG. 7 is a flowchart showing operation of the image forming apparatus of FIG. 2.

FIG. 7 is a flowchart showing operation of the image forming apparatus of FIG. 2. The operation of the image forming apparatus according to the first embodiment will be described with reference to FIG. 7. In FIG. 7, a process P1 denotes a print preparation process including steps S1-S3, a process P2 denotes a fogging adjusting process including steps S4-S6, and a process P3 denotes a printing process including a step S7.

When the speed control unit 40 receives a print job (step S1), the temperature detecting unit 31 and the humidity detecting unit 32 detect a temperature and a humidity as environmental conditions to output temperature and/or humidity information (step S2). The speed control unit 40 sets the linear speed ratio, which is a ratio of a linear speed of the surface of the developing roller 14*a* to a linear speed of the surface of the photosensitive drum 11 (step S3) on the basis of the temperature and/or humidity information.

The toner disposal control unit 52 sets the "amount of toner to be disposed of" on the basis of contents of the disposal toner amount table 42 in the speed control unit 40 (step S4). The speed control unit 40 controls the print control unit 53 so that the printing preparation is started (step S5). In accordance with a command from the toner disposal control unit 52, the print control unit 53 performs a toner disposal process before printing operation (step S6).

After the toner disposal is performed, the printing is performed (step S7) and process is finished.

According to the first embodiment, the "amount of toner to be disposed of" is changed on the basis of the linear speed ratio. In other words, as the linear speed of the surface of the developing roller 14*a* with respect to the linear speed of the surface of the photosensitive drum 11 is increased, the "amount of toner to be disposed of" from the surface of the developing roller 14*a* is increased. For this reason, the deteriorated toner, which is produced in relatively large amount when the linear speed ratio is large, can be removed effectively. As a result, regardless of the number of printed sheets, a fogging level can be kept low and therefore the printed image quality can be improved.

In the above, the description has been made that the linear speed of the surface of the photosensitive drum 11 is constant, the linear speed of the surface of the developing roller 14*a* is changed, and the "amount of toner to be disposed of" is set on the basis of the linear speed ratio. In other words, as the linear speed ratio becomes larger, it is desirable that the "amount of toner to be disposed of" be set to larger value.

However, the greater the linear speed ratio is, the more deterioration of toner on the surface of the developing roller 14*a* is accelerated. In other words, the faster the linear speed of the surface of the developing roller 14*a* is, the more the deterioration of toner on the surface of the developing roller 14*a* is accelerated. Therefore, in the first embodiment, regardless of the linear speed of the surface of the photosensitive drum 11 (i.e., regardless of the linear speed ratio), the "amount of toner to be disposed of" can be adjusted on the basis of the linear speed of the surface of the developing roller 14*a*. In other words, the faster the linear speed of the surface of the developing roller 14*a* is, the larger the "amount of toner to be disposed of" on the surface of the developing roller 14*a* is.

For example, as shown in FIG. 2, the speed control unit 40 sets a set value of the linear speed of the surface of the developing roller 14*a*, and controls the developing roller motor 18 via the motor drive and control unit 51 so that the developing roller motor 18 rotates at the linear speed of the set value.

Furthermore, the toner disposal control unit 52, which controls toner disposal process, can set the "amount of toner to be disposed of" on the basis of the linear speed of the surface of the developing roller 14*a*. In other words, the faster the linear speed of the surface of the developing roller 14*a* is, the greater the "amount of toner to be disposed of" is. In this case, the similar advantageous effect to the first embodiment can be obtained.

The "amount of toner to be disposed of" may be adjusted by changing the number of occurrence of the toner disposal processes, i.e., the frequency of the toner disposal processes, using a toner disposal pattern having the same print area ratio, in accordance with the linear speed of the surface of the developing roller 14*a*. For example, the image forming apparatus may adopt a control so that in the case of a linear speed ratio of 1.0, a toner disposal process is performed every time the developing roller 14*a* rotates 1000 revolutions, in the case of a linear speed ratio of 1.2 (i.e., when the linear speed of the surface of the developing roller 14*a* is higher than that in the case of a linear speed ratio of 1.0), a toner disposal process is performed every time the developing roller 14*a* rotates 300 revolutions, and in the case of a linear speed ratio of 1.4 (i.e., when the linear speed of the surface of the developing roller 14*a* is higher than that in the case of a linear speed ratio of 1.0 or 1.2), a toner disposal process is performed every time the developing roller 14*a* rotates 200 revolutions, while using a toner disposal pattern having the same print area ratio (e.g. 1%).

Second Embodiment

Figure 8:
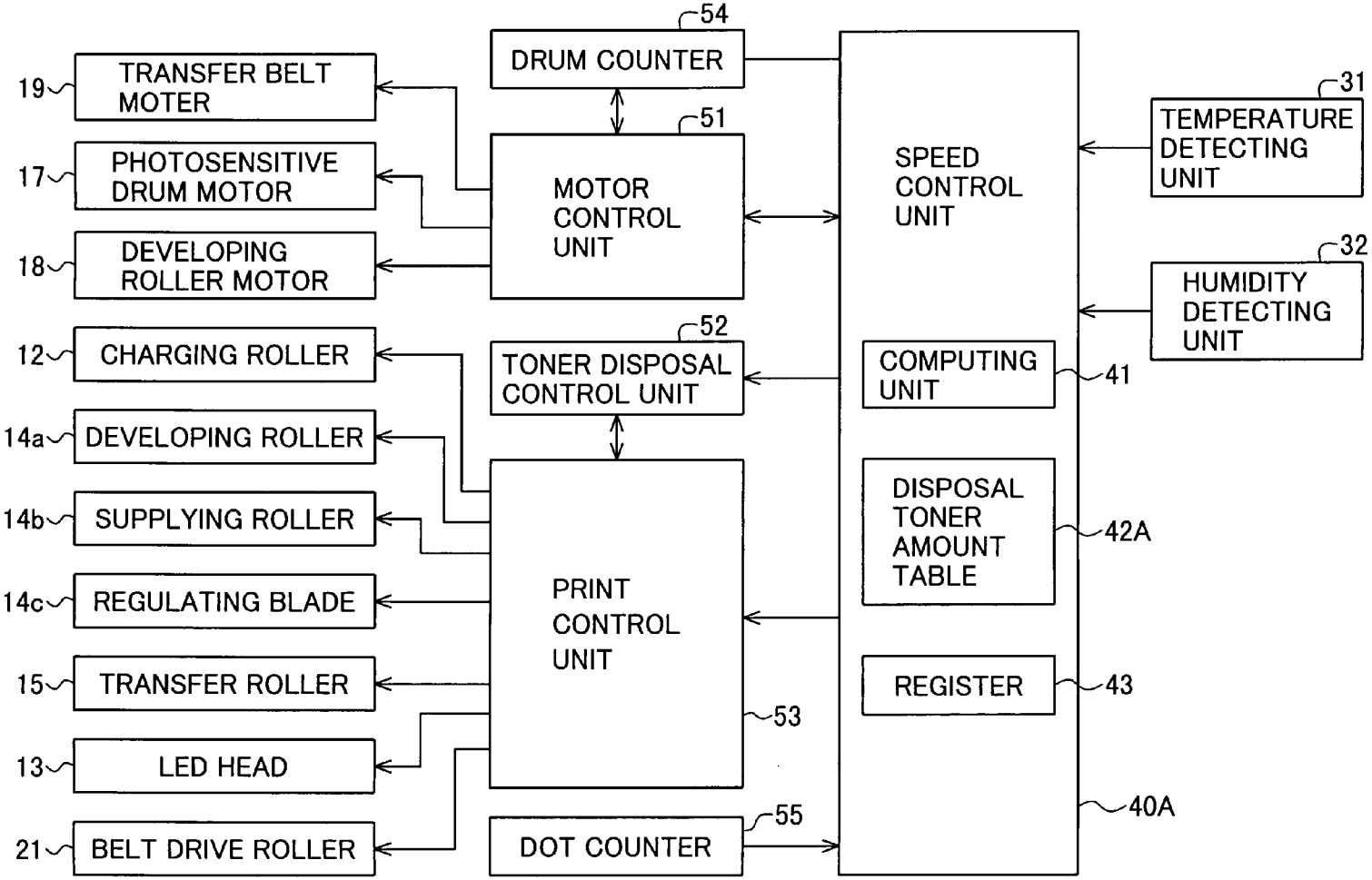
FIG. 8 is a block diagram showing a schematic circuit configuration of an image forming apparatus according to a second embodiment of the present invention.

FIG. 8 is a diagram showing a circuit configuration of an image forming apparatus according to a second embodiment of the present invention. In FIG. 8, constituent elements that are the same as or correspond to those in FIG. 2 (the first embodiment) are assigned the same reference numbers or characters.

The image forming apparatus according to the second embodiment is different from that according to the first embodiment, in respects that a speed control unit 40A of the second embodiment has a different function from the speed control unit 40 of the first embodiment, and the image forming apparatus according to the second embodiment further includes a drum counter 54, which is a device for counting the number of printed sheets or a device for counting the number of revolutions of the photosensitive drum 11, and a dot counter 55 which is a device for counting the number of dots. Further, since the image forming apparatus according to the second embodiment has similar structures to the image forming apparatus according to the first embodiment, the second embodiment will be described with reference to FIG. 1.

The speed control unit 40A is, for example, a microcomputer and so on, and includes a computing device 41 that is the same as that in the first embodiment, and a disposal toner amount table 42A which is different from the disposal toner amount table 42 in the first embodiment, and a register 43 which is a newly added device for storing the count value.

In accordance with instructions from the motor control unit 51, the drum counter 54 counts the number of revolutions of the photosensitive drum 11, thereby outputting a drum count value corresponding to the number of printed sheets. On the basis of a command from the print control unit 53, the dot counter 55 counts the number of exposure dots of the LED head 13 during the image forming process, thereby outputting a dot count value corresponding to the number of exposure dots.

A total drum count value of the photosensitive drum 11 and a total dot count value of the LED head 13 that are counted from when the toner cartridge in the developing device 14 is replaced by a new one, are stored in the register 43 of the speed control unit 40A. The drum counter 54 increments 3 counts every time 3 sheets of A4-sized paper are printed as a single job.

FIG. 9 is a diagram showing an example of contents the disposal toner amount table 42A of FIG. 8. The disposal toner amount table 42A contains set values of 0%, 1%, 2%, 3%, 4%, and 5% of the "amounts of toner to be disposed of", when the linear speed ratio is any value of 1.0, 1.2, and 1.4, and the average print image density D (%) is within any range of ($0 \leqq D < 1$), ($1 \leqq D < 3$), ($3 \leqq D < 5$), and ($5 \leqq D$).

The average print image density D (%) can be calculated by the computing device 41 of the speed control unit 40A using the following equation (1), for example.

$$D=[Cm(i)/(Cd \times Co)] \times 100 \quad (1),$$

where Cd denotes the number of revolutions of the photosensitive drum 11; Cm(i) denotes the number of actual printed dots (i.e., the number of actual exposed dots) while the photosensitive drum 11 rotates Cd revolutions; Co denotes the number of dots while the photosensitive drum rotates 1 revolution, that is, the number of potential print dots regardless of the presence or absence of exposure while the photosensitive drum rotates 1 revolution (when a solid image is printed); and (Cd×Co) means the number of potential print dots while the photosensitive drum 11 rotates Cd revolutions.

Figure 10:
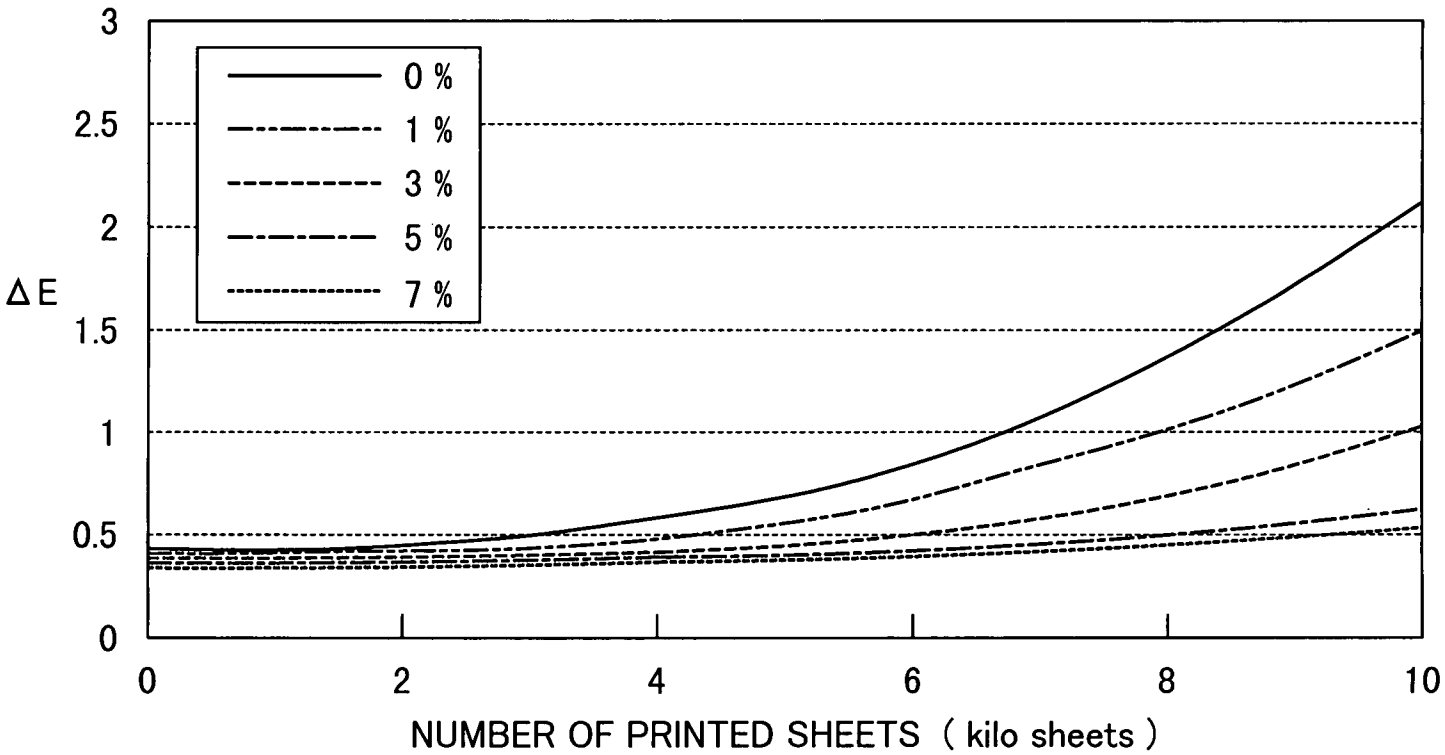
FIG. 10 is a diagram showing experimental results at a linear speed ratio of 1.4, of a relationship between the number of printed sheets and a color-difference as a fogging level in each of toner disposal amounts.

FIG. 10 is a diagram showing experimental results at the linear speed ratio of 1.4 of a relationship between the number of printed sheets and a color-difference as a fogging level in each of different toner disposal amounts.

In FIG. 10, a horizontal axis indicates the number of printed sheets of record medium P in units of "kilo sheets" (=1000 sheets), and a vertical axis denotes a color-difference ΔE.

As can be understood from FIG. 10, as the print image density D (0%, 1%, 3%, 5%, 7%) is increased, a fogging level can be kept low, and effect of improving fogging is saturated when the print image density D is 5% or more. In the second embodiment, the toner disposal control unit 52 sets the "amount of toner to be disposed of", on the basis of the average print image density D (%) and the linear speed ratio, which is a ratio of a linear speed of the surface of the developing roller 14*a* to a linear speed of the surface of the photosensitive drum 11. The average print image density D (%) is calculated by dividing the total dot count value of the LED head 13 by the total drum count value of the photosensitive drum 11, as shown as the disposal toner amount table 42A in FIG. 9.

Figure 11:
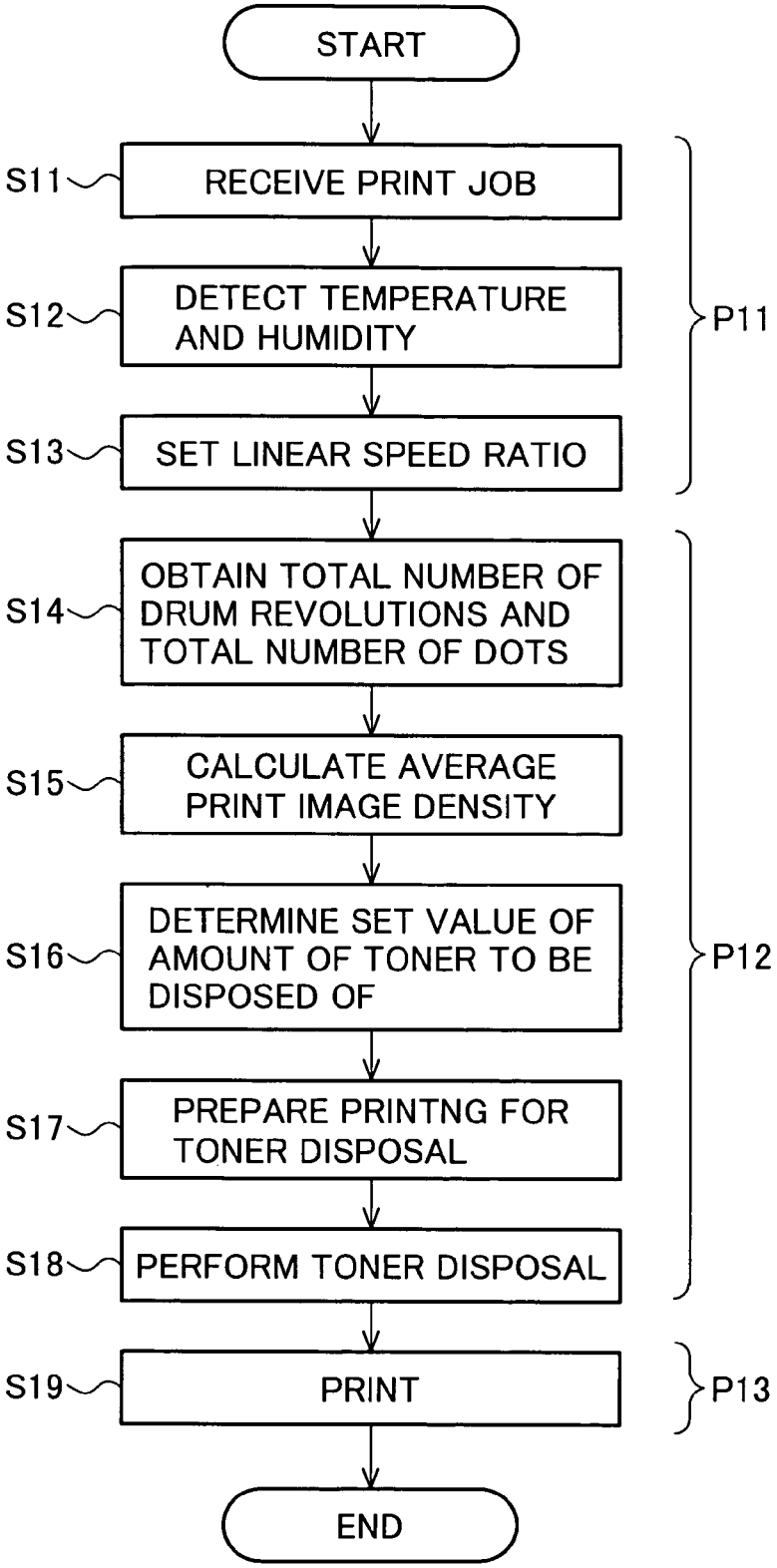
FIG. 11 is a flowchart showing operation of the image forming apparatus of FIG. 8.

FIG. 11 is a flowchart showing operation of the image forming apparatus of FIG. 8. The fogging control in the image forming apparatus of the second embodiment will be described with reference to FIG. 11. In FIG. 11, a process P11 denotes a print preparation process including steps S11-S13, a process P12 denotes a fogging adjusting process including steps S14-S18, and a process P13 denotes a printing process including a step S19.

When the fogging control is started and the speed control unit 40A receives a print job (step S11), the temperature detecting unit 31 detects an environmental temperature and the humidity detecting unit 32 detects an environmental humidity (step S12), thereby outputting temperature and/or humidity information. On the basis of the temperature and/or humidity information, the speed control unit 40A sets the linear speed ratio, which is a ratio of a linear speed of the surface of the developing roller 14*a* to a linear speed of the surface of the photosensitive drum 11 (step S13).

On the basis of a command from the motor control unit 51, the drum counter 54 counts the number of revolutions of the photosensitive drum 11, thereby outputting a drum count value corresponding to it. Furthermore, on the basis of a command from the print control unit 53, the dot counter 55 counts the number of exposed dots of the LED head 13, thereby outputting a dot count value corresponding to it. The speed control unit 40A stores the drum count value and the dot count value in the register 43, and therefore obtains a total drum count value and a total dot count value (step S14).

The computing device 41 of the speed control unit 40A calculates an average print image density D from the total drum count value and the total dot count value using the expression (1) (step S15). The speed control unit 40A sets the "amount of toner to be disposed of" on the basis of the contents in the disposal toner amount table 42A (step S16). The speed control unit 40A controls the print control unit 53 so that the printing preparation is started (step S17). On the basis of a command from the toner disposal control unit 52, the print control unit 53 performs the toner disposal process before printing (step S18). After the toner disposal process has been finished, the printing process is performed (step S19) and process is finished.

According to the second embodiment, since the "amount of toner to be disposed of" is determined by the average print image density D, when the average print image density D is large, the image forming apparatus can reduce the "amount of toner to be disposed of" while improving the quality of a printed image with a low fogging level.

The image forming apparatus may adopt another control so that the toner disposal process for disposing of the toner on a surface of the developing roller 14*a* is performed when the toner disposal control unit 52 determines that a ratio of an accumulation of the number of dots count value corresponding to the total dot count value to an accumulation of the number of printed sheets count value corresponding to the total drum count value stored in the register 43

(the ratio=1/(average print image density))

is equal to or less than a predetermined reference ratio (e.g., 1/5%=0.2%). For this reason, this modification can implement the same effects as the second embodiment has.

In the second embodiment, the amount of toner disposal is adjusted by changing the number of dots to be exposed in a circumferential direction of the photosensitive drum, that is, a length of the toner disposal pattern in a circumferential direction of the photosensitive drum, which corresponds to the linear speed of the surface of the developing roller 14*a*. However, the amount of toner disposal may be adjusted by using other toner disposal patterns, which are described below.

The 1%, 3%, and 5% patterns may be formed by keeping a length of the pattern in a circumferential direction of the surface of the developing roller 14*a*, which corresponds to a circumference of the developing roller, invariable, and changing the number of dots to be exposed in a width direction, that is, a longitudinal direction of the developing roller 14*a*.

The "amount of toner to be disposed of" may be adjusted by changing the number of occurrence of the toner disposal processes, i.e., the frequency of the toner disposal processes, using a toner disposal pattern having the same print area ratio, in accordance with the linear speed of the surface of the developing roller 14*a*. For example, the image forming apparatus may adopt a control so that in the case of a linear speed ratio of 1.0, a toner disposal process is performed every time the developing roller 14*a* rotates 3000 revolutions, in the case of a linear speed ratio of 1.2, a toner disposal process is performed every time the developing roller 14*a* rotates 2500 revolutions, and in the case of a linear speed ratio of 1.4, a toner disposal process is performed every time the developing roller 14*a* rotates 2000 revolutions, while using a toner disposal pattern having the same print area ratio.

Furthermore, for example, the image forming apparatus may adopt a control so that in the case of a linear speed ratio of 1.0, a toner disposal process is performed every time the developing roller 14*a* rotates 1000 revolutions, in the case of a linear speed ratio of 1.2 (i.e., when the linear speed of the surface of the developing roller 14*a* is higher than that in the case of a linear speed ratio of 1.0), a toner disposal process is performed every time the developing roller 14*a* rotates 300 revolutions, and in the case of a linear speed ratio of 1.4 (i.e., when the linear speed of the surface of the developing roller 14*a* is higher than that in the case of a linear speed ratio of 1.0 or 1.2), a toner disposal process is performed every time the developing roller 14*a* rotates 200 revolutions, while using a toner disposal pattern having the same print area ratio (e.g. 1%).

The number of revolutions of the developing roller 14*a* can be calculated from the number of revolutions of the photosensitive drum 11, a ratio between the circumferential speeds, and a ratio between the outer diameters. Furthermore, the image forming apparatus may have a developing roller count unit for counting the number of revolutions of the developing roller 14*a*.

Modifications of Embodiments

The present invention is not limited to the above-described first and second embodiments and their modifications, and can be applied to other embodiments and their other modifications. The image forming apparatuses shown in FIG. 1, FIG. 2 and FIG. 8 can be modified so as to have different configurations from those shown in these figures.

For example, the photosensitive drum motor 17 and the developing roller motor may be replaced by a single drive motor for driving both the photosensitive drum 11 and the developing roller 14*a*.

Further, the speed control unit 40 or 40A may be configured so that it determines the amount of developer to be disposed of on the basis of the determined rotation speed of the developing roller 14*a* and controls disposal of the determined amount of developer on the surface of the developing roller 14*a*.

Furthermore, the speed control unit 40 or 40A may have a function of adjusting the rotation speed of the developing roller 14*a* relative to a rotation speed of the photosensitive drum 11.

Moreover, the present invention can be applied to other image forming apparatuses such as a photocopier, a facsimile apparatus, a multifunction peripheral (MFP), and the like, in addition to the printer.

What is claimed is:

1. An image forming apparatus comprising:

a developer bearing body for supplying developer to a surface of an image bearing body, on which an electrostatic latent image is formed by a latent image forming unit;

a driving unit for rotating the developer bearing body;

a speed control unit for determining a rotation speed of the developer bearing body;

a drive control unit for controlling the driving unit so that the developer bearing body rotates at the determined rotation speed;

a control unit for determining the amount of developer to be disposed of on the basis of the determined rotation speed and controlling disposal of the determined amount of developer on the surface of the developer bearing body to dispose of the determined amount of developer;

a first counter for counting the number of light dots; and a second counter for counting the number of revolutions of the image bearing body; wherein the control unit performs the disposal of the developer before or after printing on a record medium;

the latent image forming unit includes an exposing unit for irradiating the surface of the image bearing body with the light dots, thereby forming dots of the electrostatic latent image; and the determined rotation speed is a value based on an accumulation of the number of dots obtained by the first counter and an accumulation of the number of revolutions obtained by the second counter.

2. The image forming apparatus according to claim 1, wherein the control unit performs the disposal of the developer on a surface of the developer bearing body using the electrostatic latent image pattern having a constant print area ratio with a frequency based on the determined amount of developer.

3. An image forming apparatus comprising:

a developer bearing body for supplying developer to a surface of an image bearing body, on which an electrostatic latent image is formed by a latent image forming unit;

a driving unit for rotating the developer bearing body;

a speed control unit for determining either a first rotation speed or a second rotation speed different from the first rotation speed as a rotation speed of the developer bearing body;

a drive control unit for controlling the driving unit so that the developer bearing body rotates at the determined rotation speed; and a control unit for determining, as an amount of developer to be disposed of, a first disposal amount of developer when the determined rotation speed is the first rotation speed or a second disposal amount of developer different from the first disposal amount of developer when the determined rotation speed is the second rotation speed and for controlling disposal of the determined amount of developer on a surface of the developer bearing body to dispose of the determined amount of developer; wherein the control unit performs the disposal of the developer before or after printing on a record medium;

the first rotation speed is faster than the second rotation speed; and the first disposal amount of developer is larger than the second disposal amount of developer.

4. The image forming apparatus according to claim 3, further comprising:

a table that stores relationships between the rotation speed of the developer bearing body and the amount of developer to be disposed of;

wherein the control unit determines the amount of developer to be disposed of by referring to the table.

5. The image forming apparatus according to claim 3, wherein the speed control unit determines the rotation speed of the developer bearing body during printing on the record medium.

6. The image forming apparatus according to claim 3, further comprising:

a temperature detecting unit for detecting an environmental temperature; and a humidity detecting unit for detecting an environmental humidity;

wherein the speed control unit determines the rotation speed of the developer bearing body based on the detected environmental temperature and the detected environmental humidity.

7. The image forming apparatus according to claim 3, wherein the determined rotation speed is expressed by a linear speed as a circumferential speed of the surface of the developer bearing body.

8. The image forming apparatus according to claim 3, wherein the determined rotation speed is expressed by a linear speed ratio, which is a ratio of a second linear speed as a circumferential speed of the surface of the developer bearing body to a first linear speed as a circumferential speed of the surface of the image bearing body.

9. The image forming apparatus according to claim 3, wherein the rotation speed of the developer bearing body is a rotation speed relative to a rotation speed of the image bearing body.

10. The image forming apparatus according to claim 3, wherein:

the control unit causes the latent image forming unit to form an electrostatic latent image pattern on the surface of the image bearing body, the pattern being determined on the basis of the determined amount of developer; and a length of the pattern in a circumferential direction or in a width direction is changed on the basis of the determined amount of developer.

11. The image forming apparatus according to claim 3, wherein the speed control unit has a function of adjusting the rotation speed of the developer bearing body relative to a rotation speed of the image bearing body.

12. The image forming apparatus according to claim 3, further comprising:

a drum cleaning unit for removing the developer from the surface of the image bearing body;

wherein the developer on the surface of the image bearing body is removed by the drum cleaning unit.

13. The image forming apparatus according to claim 3, further comprising:

a transfer belt;

a transfer belt driving unit for driving the transfer belt;

a transfer roller for transferring the developer on the surface of the image bearing body to the transfer belt; and a belt cleaning unit for removing the developer on an outer surface of the transfer belt;

wherein the developer on the surface of the image bearing body is moved to the transfer belt and thereafter removed by the belt cleaning unit.

* * * * *